SELF-CONTAINED CLOSURE FOR WRITING INSTRUMENTS AND THE LIKE

This application is based on Disclosure Document 037348 filed about December 15, 1974.

This invention relates to a new and improved self-contained closure for writing instruments such as ball and felt-tipped pens, pencils, scribes, punches and similar implements.

A principal object of the invention is to provide an instrument having a cap covering the tip contained as an integral part of the instrument so that it need not be attached and removed as are common pen caps and thus the cap is not subject to loss. A feature of the construction is the fact that the cap may be moved from operative to storage position with the same hand which holds the instrument.

Another feature of the invention is the fact that when the instrument is being used the cap is nested into the barrel of the instrument for storage.

Another feature of the invention is the provision of a clip to attach to the pocket of the wearer which is movable with the cap between storage and operative positions.

Still another feature of the invention is the provision of a construction having few parts and little complexity so as to facilitate mass production and assembly.

A still further feature of the invention is the fact that the clip and cap oscillate between storage and operative positions and, in a preferred embodiment of the invention, snap into position.

Other objects of the present invention will become apparent upon reading the following specification and referring to the accompanying drawings in which similar characters of reference represent corresponding parts in each of the several views.

FIGS. 5–8, inclusive, are views similar to FIGS. 1–4, respectively, of a modification.

Figure 3:
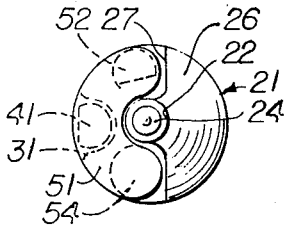
FIG. 3 is an end elevational view of the structure of FIG. 1.
Figure 9:
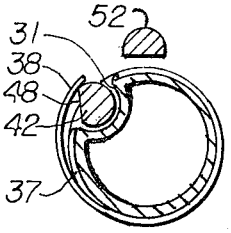
Figure 5:
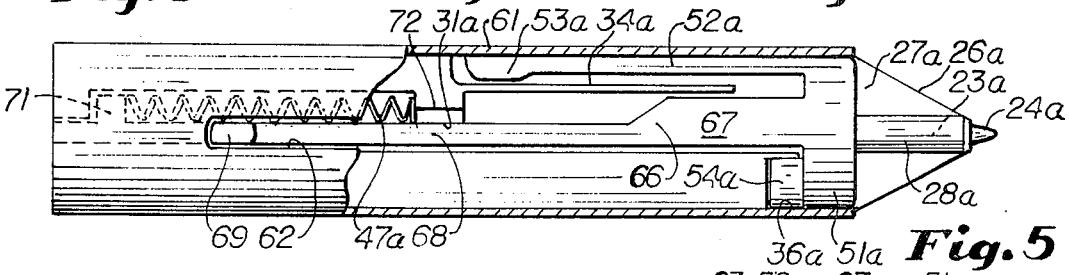
Figure 6:
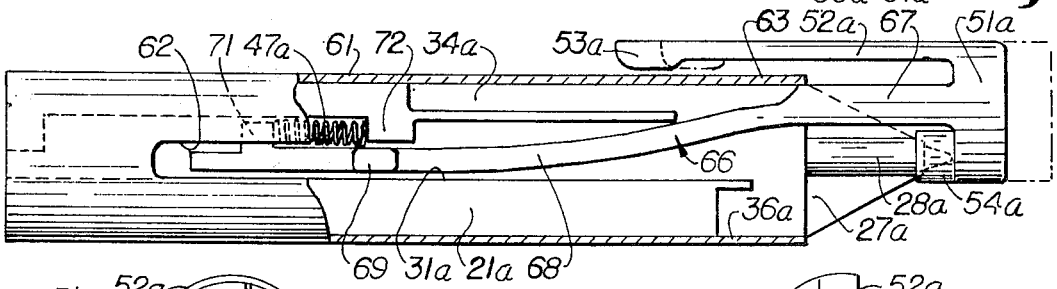
Figure 7:
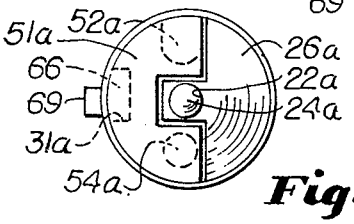
Figure 8:
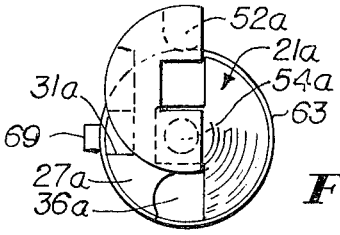

FIG. 9 is a section along the line 9—9, FIG. 3.

Directing attention first to the modification of FIGS. 1–4, a barrel 21 preferably of round cross section is provided and is formed with a central aperture 22 extending in from the top (lefthand as viewed in FIGS. 1 and 2) end. Fixed within aperture 22 is a pen 23, pencil, scribe, punch, etc., having its tip 24 projecting slightly out of the upper end of the barrel 21. The object of the present invention is to provide a retractable cap for tip 24.

The upper end of barrel 21 is formed with a semi-conical end 26 and about 180° of end 26 is cutaway as indicated by reference numeral 27. A semi-cylindrical sleeve 28 surrounds the upper end of pen 23 and permits projection of tip 24 but retains the pen 23 in place.

A main groove 31 extends longitudinally of barrel 21 on the surface thereof which is angularly midway of the cutaway portion 27 as is best shown in FIG. 3. A restriction 32 is formed in main groove 31 about midway of its length. A hole 33 is formed aligned with groove 31 at the end opposite cutaway portion 27. Clip depression 34 is formed in the outside of barrel 21 extending from below cutaway portion 27 and diametrically opposite depression 34 is cap depression 36 which is of lesser length than depression 34. Circumferential grooves 37 are formed in barrel 21 adjacent opposite ends thereof to receive top ring 38 and bottom ring 39 which are of a spring construction.

Figure 1:
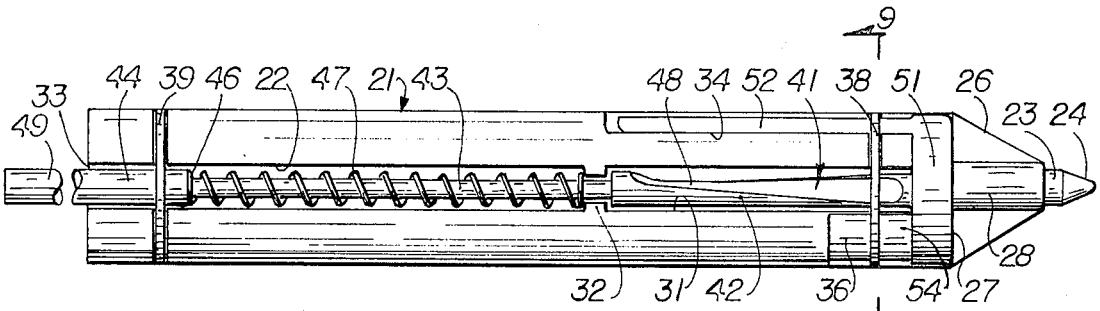
FIG. 1 is a side elevational view of one modification of the instrument of the present invention showing the cap in retracted position.

Positioned in main groove 31 is longitudinal shaft 41 having large diameter upper end 42, small diameter middle portion 43 and large diameter lower portion 44. Shoulder 46 is formed at the lower end of small diameter portion 43 and a helical spring 47 surrounds small diameter portion 43 and bears at its left end against shoulder 46 and at its right end against restriction 32 and thus biases shaft 41 to the left as viewed in FIGS. 1 and 2. As best shown in FIG. 1, a spiral rib 48 is formed in large diameter portion 42 for a purpose which is hereinafter explained. The left end of shaft 41 projects as indicated by reference numeral 49.

Figure 4:
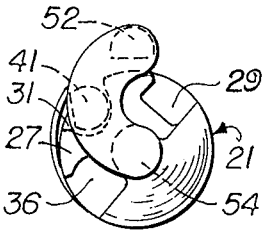
FIG. 4 is an end elevational view of the structure of FIG. 2.

On the right-hand end of shaft 41 is a fitting 51 which is arcuate as viewed in end elevation in FIGS. 3 and 4. Projecting downward from diametrically opposite ends of fitting 51 are a pocket clip 52 having an inward boss 53 which attaches the device to the pocket of the wearer and a hollow cap 54 which fits over tip 24.

In the operative position of the instrument shown in FIGS. 1 and 3, tip 24 is unobstructed for writing or other use. Clip 52 is nested in recess 34 and fits under top ring 38 while cap 54 nests in depression 36. It will be noted that the end 49 of shaft 41 projects out the left-hand end of the barrel 21 through hole 33. In this position neither the clip 52 nor cap 54 interferes with the use of the instrument.

Figure 2:
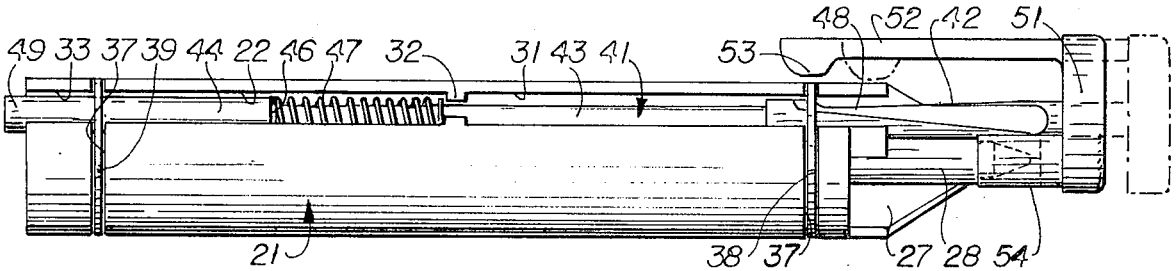
FIG. 2 is a side elevational view rotated from the position of FIG. 1 and showing the cap in operative position in solid lines and in a position preliminary to operative position in dot-and-dash lines.

When it is desired to cover tip 24, the user depresses end 49 toward the right, as viewed in FIGS. 1 and 2, causing the spring 47 to be compressed and the fitting 51 to move from the solid line position of FIG. 1 to the dot-and-dash position of FIG. 2. The rib 48 has a flat outer surface which engages ring 38, but because the clip 52 is under said ring, the ring 38 stretches (expands) until the clip 52 is to the right of spring 38 whereupon the contracting action of the ring 38 on the rib 48 causes a rotation of shaft 41 and fitting 51 from the position of FIG. 3 to the position of FIG. 4. When the end 49 is released, spring 47 retracts the fitting 51 from the dot-and-dash line position of FIG. 2 to the solid line position thereof, and thereupon the cap 54 fits down over the tip 24 and conceals the same.

When it is necessary to return the cap 54 to retracted position, the user pushes the clip 52 to the right, as viewed in FIG. 2, to dot-and-dash position and then inward-bearing thumb pressure turns it from the position of FIG. 4 back to the position of FIG. 3. The spring 47 causes the shaft 41 and hence the clip 52 and cap 54 to return to the original position with the clip in depression 34 and the cap in depression 36.

Directing attention now to the modification of FIGS. 5–8, many of the elements of the structure are the same as in the preceding modification and the same, or substantially the same, elements are indicated by the same reference numerals followed by the subscript *a*. In this modification, the barrel 21*a* is surrounded by a sleeve 61 which is formed with a longitudinally extending elongated slot 62 about midway of the length of the instrument and a longitudinally extending notch 63

United States Patent [19]

Fomby

[11] 3,992,116

[45] Nov. 16, 1976

[54] APPLICATOR BRUSH AND METHOD OF MAKING SAME

[76] Inventor: Kenneth A. Fomby, 402 Lindsay St., Gainesville, Tex. 76240

[22] Filed: Apr. 23, 1975

[21] Appl. No.: 570,844

Related U.S. Application Data

[62] Division of Ser. No. 338,384, March 5, 1973, Pat. No. 3,895,877.

[52] U.S. Cl. ..... 401/129; 300/21

[51] Int. Cl.[2] ..... A46B 3/02

[58] Field of Search ..... 15/193, 257.05; 300/21; 401/121, 122, 126–130

[56] References Cited

UNITED STATES PATENTS

| | | | |
|---|---|---|---|
| 624,934 | 5/1899 | Higgins | 401/128 X |
| 1,021,709 | 3/1912 | Snow | 401/129 |
| 1,690,035 | 10/1928 | O'Neill et al. | 401/129 |
| 2,075,570 | 3/1937 | Carpenter | 300/21 |
| 2,310,186 | 2/1943 | Abrams | 300/21 X |
| 2,391,077 | 12/1945 | Sticht | 300/21 |
| 3,085,281 | 4/1963 | Massman | 401/128 X |
| 3,469,928 | 9/1969 | Widegren | 401/128 X |

FOREIGN PATENTS OR APPLICATIONS

| | | | |
|---|---|---|---|
| 1,174,544 | 11/1958 | France | 401/128 |
| 39,591 | 6/1965 | Germany | 401/129 |
| 1,006,392 | 4/1957 | Germany | 300/21 |
| 503,026 | 10/1955 | Italy | 300/21 |
| 471,782 | 9/1937 | United Kingdom | 401/129 |

*Primary Examiner*—Daniel Blum
*Attorney, Agent, or Firm*—Wayland D. Keith

[57] ABSTRACT

An applicator brush handle with a self contained attachment cap for sealing a container, with the cap closing the container in air tight relation, when not in use, and with the handle extending upward from the cap, which handle and cap are molded integrally to eliminate assembly. The brush projects into the container when not in use, and the cap or cover may be readily removed, as by unscrewing, or the like, when it is desirable to use the material within the container, such as glue, cement, paint or other liquid to be coated onto a surface. Provision is made for molding the cap or cover integrally with the handle and with the portion to which the brush bristles are attached. Further provision is made to mold a socket in the stem to receive the brush bristles.

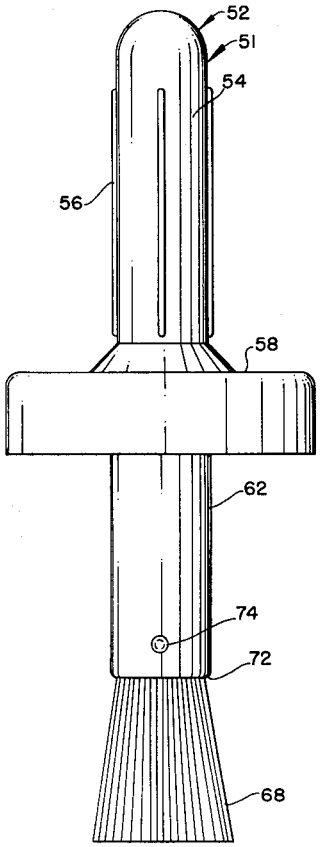

2 Claims, 7 Drawing Figures